US009098098B2

(12) United States Patent
Shaeffer et al.

(10) Patent No.: US 9,098,098 B2
(45) Date of Patent: Aug. 4, 2015

(54) CURVATURE-CORRECTED BANDGAP REFERENCE

(71) Applicant: InvenSense, Inc., Sunnyvale, CA (US)

(72) Inventors: Derek Shaeffer, Redwood City, CA (US); Nauman Afzal, San Ramon, CA (US)

(73) Assignee: INVENSENSE, INC., San Jose, CA (US)

( * ) Notice: Subject to any disclaimer, the term of this patent is extended or adjusted under 35 U.S.C. 154(b) by 287 days.

(21) Appl. No.: 13/722,679

(22) Filed: Dec. 20, 2012

(65) Prior Publication Data

US 2014/0117966 A1 May 1, 2014

Related U.S. Application Data

(60) Provisional application No. 61/721,387, filed on Nov. 1, 2012.

(51) Int. Cl.
*G05F 3/16* (2006.01)
*G05F 3/02* (2006.01)

(52) U.S. Cl.
CPC ..... *G05F 3/02* (2013.01)

(58) Field of Classification Search
CPC ..... G05F 3/30; G05F 3/262
USPC ..... 323/311, 312, 313, 314, 315, 316, 317
See application file for complete search history.

(56) References Cited

U.S. PATENT DOCUMENTS 4,327,320 A * 4/1982 Oguey et al. ..... 323/313
5,352,973 A * 10/1994 Audy ..... 323/313
5,767,664 A 6/1998 Price
6,157,245 A 12/2000 Rincon-Mora
6,342,781 B1 1/2002 Laraia
6,384,586 B1 * 5/2002 Sugawara ..... 323/313
7,088,085 B2 8/2006 Marinca
7,253,597 B2 8/2007 Brokaw (Continued)

OTHER PUBLICATIONS

Brokaw, Paul A. "A Simple Three-Terminal IC Bandgap Reference" (Dec. 1974) IEEE Journal of Solid-State Circuits, vol. SC-9, No. 6.

(Continued)

*Primary Examiner* — Adolf Berhane
*Assistant Examiner* — Alex Torres-Rivera
(74) *Attorney, Agent, or Firm* — Sawyer Law Group, P.C.

(57) ABSTRACT

A curvature-corrected bandgap reference is disclosed. The curvature-corrected bandgap reference comprises a Brokaw bandgap circuit. The Brokaw bandgap circuit includes an output node providing a reference voltage. The Brokaw bandgap circuit further comprising a first BJT device including a first base terminal coupled to the output node and a first emitter terminal. The first BJT device operates at a first current density that is substantially proportional to absolute temperature. The curvature-corrected bandgap reference also includes a second BJT device including a second base terminal coupled to the output node and a second emitter terminal. The second BJT device operates at a second current density that is substantially independent of temperature. Finally the curvature-corrected bandgap reference includes a correction voltage proportional to a voltage difference of the first and second emitter terminals, wherein the correction voltage substantially cancels a curvature of the reference voltage.

15 Claims, 10 Drawing Sheets

200

(56) References Cited

U.S. PATENT DOCUMENTS

| | | | | |
|---|---|---|---|---|
| 7,420,359 | B1 | 9/2008 | Anderson et al. | |
| 7,598,799 | B2 | 10/2009 | Marinca | |
| 7,605,578 | B2 | 10/2009 | Marinca | |
| 7,960,961 | B2 | 6/2011 | Cave | |
| 8,106,707 | B2 | 1/2012 | Katyal et al. | |
| 2004/0124822 | A1* | 7/2004 | Marinca | 323/313 |
| 2005/0194957 | A1* | 9/2005 | Brokaw | 323/316 |
| 2007/0052473 | A1* | 3/2007 | McLeod | 327/539 |
| 2007/0170906 | A1 | 7/2007 | Marinca | |
| 2009/0160537 | A1 | 6/2009 | Marinca | |

OTHER PUBLICATIONS

Widlar, Robert J. "New Developments in IC Voltage Regulators" (Feb. 1971) IEEE Journal of Solid-State Circuits, vol. SC-6, No. 1.

Widlar, Robert J. "New Developments in IC Voltage Regulators" (Feb. 1971) IEEE Journal of Solid-State Circuits, vol. SC-6, No 1.

* cited by examiner

CURVATURE-CORRECTED BANDGAP REFERENCE

FIELD OF THE INVENTION

The present invention relates generally to integrated circuits and more particularly to precision voltage references based on the bandgap voltage of silicon.

BACKGROUND OF THE INVENTION

Bandgap voltage references are commonly used in integrated circuit designs to provide a reference voltage with good temperature stability. There is a need to improve the performance and accuracy of such designs. The present invention addresses such a need.

SUMMARY OF THE INVENTION

A curvature-corrected bandgap reference is disclosed. The curvature-corrected bandgap reference comprises a Brokaw bandgap circuit. The Brokaw bandgap circuit includes an output node providing a reference voltage. The Brokaw bandgap circuit further comprises a first BJT device including a first base terminal coupled to the output node and a first emitter terminal. The first BJT device operates at a first current density that is substantially proportional to absolute temperature.

The curvature-corrected bandgap reference also includes a second BJT device including a second base terminal coupled to the output node and a second emitter terminal. The second BJT device operates at a second current density that is substantially independent of temperature. Finally the curvature-corrected bandgap reference includes a correction voltage proportional to a voltage difference of the first and second emitter terminals, wherein the correction voltage substantially cancels a curvature of the reference voltage.

DETAILED DESCRIPTION

The present invention relates generally to curvature-corrected bandgap references. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

Figure 1:
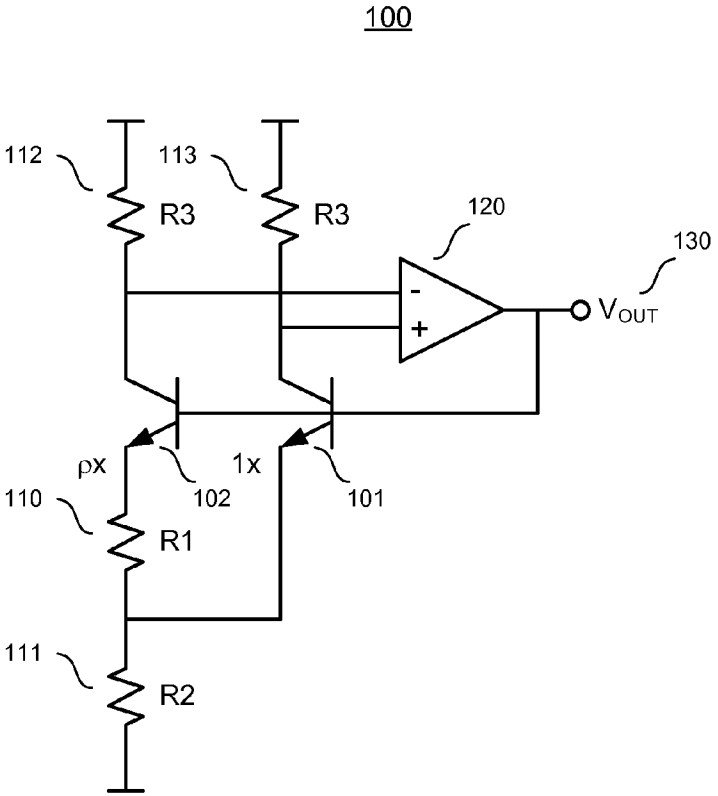
Figure 1 (Prior Art)
FIG. 1 shows a prior-art implementation of a Brokaw bandgap reference.

A variety of second-order effects limits the accuracy of bandgaps. For example, BJT devices possess finite current gain and therefore draw a finite base current. The base current varies significantly over temperature and can be a source of additional temperature dependence in some bandgap topologies. A well-known canonical topology addressing this issue was taught by Brokaw in the paper entitled, "A Simple Three Terminal IC Bandgap Reference," published in the IEEE Journal of Solid State Circuits, Vol. SC-9, No. 6, December, 1974. In his topology, referred herein as the Brokaw bandgap circuit for reference in FIG. 1, the bases of the BJT devices 101-102 are advantageously driven by an operational amplifier 120 so that base current has negligible influence on the output voltage. The operational amplifier monitors the collector currents of BJT devices 101-102 via resistors 112-113 and by feedback action, ensures their equality (assuming, for example, that resistors 112-113 are of equal resistance). The BJT device 102 has ρ-times the emitter area of BJT device 101, and therefore the devices operate a current densities that differ by a fixed factor of ρ. The $\Delta V_{BE}$ voltage is sensed in the loop comprising BJT devices 101-102 and resistor R1 110, leading to current flow in both BJT devices 101-102 that is proportional to absolute temperature (PTAT). This current flow is also conducted through resistor R2 111, and thus the output voltage, $V_{OUT}$ 130, is given by the $V_{BE}$ of BJT 101, which is complementary to absolute temperature (CTAT), plus the voltage seen across R2 111, which is PTAT. By proper selection of R1 110 and R2 111, the output voltage, $V_{OUT}$ 130, can be made independent of temperature variation, at least to first-order. Other advantages of the Brokaw topology include relative insensitivity to operational amplifier offsets and direct regulation of collector current, which directly relates to the $V_{BE}$ voltage of the device without any influence of base currents.

A disadvantage of the aforementioned bandgap reference topologies is that they suffer from residual temperature curvature due to a nonlinear dependence of $V_{BE}$ on temperature (so-called "$V_{BE}$ curvature"). This curvature limits the temperature stability of bandgap references to around 1%. To obtain better temperature stability, it is necessary to introduce curvature correction into the basic bandgap topology. An object of the present invention is to extend the basic topology taught by Brokaw to incorporate curvature correction while maintaining the other inherent benefits of the Brokaw topology.

A variety of curvature correction schemes have been taught in the prior art, including those taught in the attached references. Briefly, prior-art approaches to curvature correction can be summarized by several types. In a first type of approach, a nonlinear correction voltage that is a function of temperature is derived using a voltage-to-current converter with an input voltage that is temperature-dependent and then utilized for curvature correction. In a second type of approach, a piecewise-linear correction voltage is supplied. In a third type of approach, a bias current proportional to a higher power of temperature is supplied to reduce the $V_{BE}$ curvature by exploiting the high-order temperature dependence of BJT current gain. In a fourth type of approach, a temperature-dependent resistor is introduced to provide a compensating voltage related to the square of absolute temperature. A limitation of these approaches is that the curvature correction depends on dissimilar devices to the BJT transistor and therefore the accuracy of the compensation is subject to process variation.

In a different type of approach, a nonlinear correction voltage is provided by biasing a BJT device with a current that is an affine function of temperature. While this approach theoretically provides curvature correction that is largely process insensitive, it is not easily incorporated into the Brokaw topology due to the need for dissimilar current biasing of the two devices generating the $\Delta V_{BE}$ voltage.

In yet a different type of approach, a nonlinear correction is provided by producing a logarithmic voltage related to a difference between $V_{BE}$'s of two BJT devices, one of which is biased by a substantially PTAT current, and the other of which is biased by a substantially temperature-independent current. In the above identified approach, several BJT devices and multiple current mirrors are employed to generate the temperature-compensated output voltage, and thus his technique also suffers from significant current-mirror and amplifier offset sensitivity.

In light of the limitations of conventional bandgap curvature correction techniques, it would be useful to have a curvature correction technique that provides substantially process-insensitive curvature correction while retaining the benefits provided by the canonical Brokaw topology.

In accordance with the present invention a curvature-corrected bandgap reference is disclosed that overcomes the above identified issues. To describe the features of the reference please refer now to the following description in conjunction with the accompanying Figures.

The base-emitter voltage ($V_{BE}$) of a bipolar junction transistor (BJT) is given by the expression $$V_{BE} = V_{G0} + \left(\frac{T}{T_0}\right)(V_{BE0} - V_{G0}) + m\left(\frac{kT}{q}\right)\ln\left(\frac{T_0}{T}\right) + \frac{kT}{q}\ln\left(\frac{J}{J_0}\right) \quad (1)$$

where $V_{G0}$ is the bandgap of silicon, $V_{BE0}$ is the base-emitter voltage at a reference current density $J_0$ taken at reference temperature $T_0$, m is a process dependent factor on the order of 3, J is the operating current density, T is the absolute temperature, k is Boltzmann's constant and q is the electron charge. This expression tells us that $V_{BE}$ is approximately linear function of temperature, except for the third and fourth terms in the summation. The third term produces nonlinear curvature due to logarithmic dependence on temperature. The fourth term may or may not produce curvature, depending on the temperature exponent of the operating current density.

A temperature-independent curvature-corrected reference voltage may be generated in principle by taking an appropriate summation of the VBE's of three BJT devices, two of which are biased with PTAT current densities maintained at a fixed ratio, ρ, and the third of which is biased at a constant current density, $J_0$. If we define the PTAT current density of the first BJT as $J_0 \cdot (T/T_0)$, and the PTAT current density of the second BJT as $(J_0/\rho)\cdot(T/T_0)$, then we have $$V_{BE1} = V_{G0} + \left(\frac{T}{T_0}\right)(V_{BE0} - V_{G0}) + (m-1)\left(\frac{kT}{q}\right)\ln\left(\frac{T_0}{T}\right) \quad (2)$$

-continued $$V_{BE2} = V_{G0} + \left(\frac{T}{T_0}\right)(V_{BE0} - V_{G0}) + (m-1)\left(\frac{kT}{q}\right)\ln\left(\frac{T_0}{T}\right) - \frac{kT}{q}\ln(\rho) \quad (3)$$

$$V_{BE3} = V_{G0} + \left(\frac{T}{T_0}\right)(V_{BE0} - V_{G0}) + m\left(\frac{kT}{q}\right)\ln\left(\frac{T_0}{T}\right) \quad (4)$$

Then, we can define $\Delta V_{BE12}$ and $\Delta V_{BE13}$ as follows $$\Delta V_{BE12} \triangleq V_{BE1} - V_{BE2} = \frac{kT}{q}\ln(\rho) \quad (5)$$

$$\Delta V_{BE13} \triangleq V_{BE1} - V_{BE3} = -\frac{kT}{q}\ln\left(\frac{T_0}{T}\right) \quad (6)$$

Note that $\Delta V_{BE12}$ is PTAT and $\Delta V_{BE13}$ is proportional to the curvature of $V_{BE1}$. A curvature-corrected, temperature-independent reference voltage can then be formed by taking the weighted summation of $V_{BE1}$, $\Delta V_{BE12}$ and $\Delta V_{BE13}$ $$V_{REF} = V_{BE1} + \alpha_1 \Delta V_{BE12} + \alpha_2 \Delta V_{BE13} \quad (7)$$

$$V_{REF} = V_{G0} + \left(\frac{T}{T_0}\right)(V_{BE0} - V_{G0}) + \alpha_1 \frac{kT}{q}\ln(\rho) + (m - 1 - \alpha_2)\left(\frac{kT}{q}\right)\ln\left(\frac{T_0}{T}\right) \quad (8)$$

The temperature-dependent and curvature-related terms cancel, provided that $$\alpha_1 = \frac{q(V_{G0} - V_{BE0})}{kT_0\ln(\rho)} \quad (9)$$

$$\alpha_2 = m - 1. \quad (10)$$

If this condition is met, then $V_{REF}=V_{G0}$, which is just the bandgap voltage of silicon.

Figure 2:
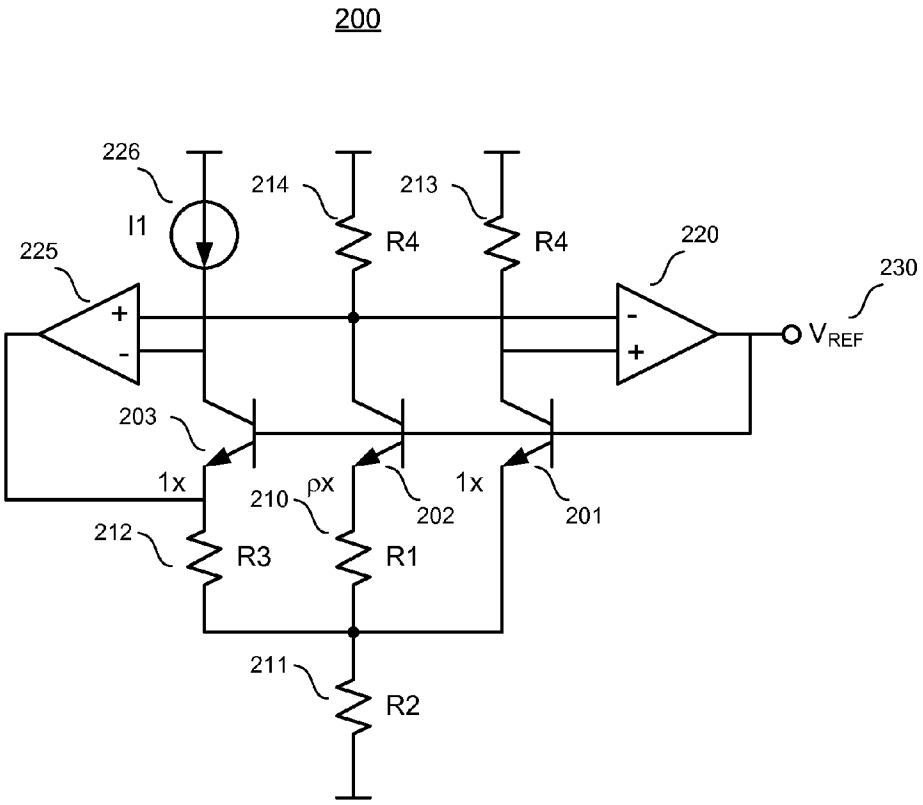
FIG. 2 shows an embodiment of a curvature-corrected bandgap reference according to the present invention.

As will now be explained, the exemplary embodiment of FIG. 2 provides a curvature-corrected bandgap reference meeting the conditions described above. In this embodiment, three BJT transistors 201-203 provide the three $V_{BE}$ voltages corresponding to the above expressions, and three resistors 210-212 provide the necessary weighted summation of the $V_{BE}$ voltages such that the resulting reference voltage, $V_{REF}$ 230, is temperature-independent and curvature-compensated. Let $V_{BE,201}$ be the base-emitter voltage of transistor 201; let $V_{BE,202}$ be the base-emitter voltage of transistor 202; and let $V_{BE,23}$ be the base-emitter voltage of transistor 203. Define $V_{BE1}=V_{BE,201}$, $\Delta V_{BE12}=V_{BE,201}-V_{BE,202}$ and $\Delta V_{BE13}=V_{BE,201}-V_{BE,203}$. Then, we see that $\Delta V_{BE12}$ appears across resistor R1 210 and that $\Delta V_{BE13}$ appears across resistor R3 212. Resistors R4 213-214 and operational amplifier 220 monitor the collector currents of BJT's 201-202 and by feedback action to the base of those transistors ensure that the collector currents are made equal. Since BJT 202 has ρ-times the emitter area of BJT 201, the current density is ρ-times less in BJT 202 than in BJT 201. Furthermore, since $\Delta V_{BE12}$ is PTAT, the currents flowing in BJT's 201-202 are both equal and PTAT, and their current densities are maintained in a fixed ratio, ρ. The collector current flowing in BJT 203 is set by current source I1 226 by virtue of the feedback action of operational amplifier 225. I1 226 is assumed to be independent of temperature and equal to the collector currents flowing in BJT's 201-202 at a reference temperature, $T_0$. Accordingly, the reference voltage, $V_{REF}$ 230, is the sum of $V_{BE,101}$ and the voltage across R2 211, which is simply $$V_{REF} = V_{BE1} + \left(\frac{2R2}{R1}\right)\Delta V_{BE12} + \left(\frac{R2}{R3}\right)\Delta V_{BE13} \tag{11}$$

Note that expression (11) is equivalent to expression (7), where $$\alpha_1 = \left(\frac{2R2}{R1}\right) \tag{12}$$

$$\alpha_2 = \left(\frac{R2}{R3}\right). \tag{13}$$

Therefore, we can expect that $V_{REF}$ will be equal to $V_{G0}$, provided that $$\frac{2R2}{R1} = \frac{q(V_{G0} - V_{BE0})}{kT_0 \ln(\rho)} \tag{14}$$

$$\frac{R2}{R3} = m - 1. \tag{15}$$

In practice, one or more resistors 210-212 may be trimmed in production to substantially obtain the necessary equalities of expressions (14) and (15), which include process-dependent parameters $V_{BE0}$ and m. In some cases, the process dependence of m may be acceptable so that the ratio R2/R3 may be set to a fixed ratio that need not be trimmed for each part. Process variation of $V_{BE0}$, however, will typically dictate that either R1 210 or R2 211 be trimmed so that the desired output voltage, $V_{G0}$, is reliably obtained. Such trimming can also compensate for any systematic error in the current density ratio, ρ.

An advantage of the present technique is that the curvature correction depends directly on the resistor R3 212, whereas overall temperature slope correction depends directly on resistor R1 210. Thus, the functions of temperature slope and curvature correction relate to separate circuit components, thereby simplifying the task of devising production trims for these components. For example, the system may first be trimmed for optimized curvature using R3 212, and then optimized for slope using R1 210. In many cases, first order correction of the curvature suffices, and R3 212 can be set to a fixed value, thereby enabling a single-point trim of R1 210 to obtain the correct output voltage, $V_{G0}$.

BJT devices 201-203 and resistors 210-212 form the core of the present invention. Additional components are the collector resistors 213-214, current source I1 226 and operational amplifiers 220 and 225. These elements are illustrated generically in FIG. 2. There are many ways of implementing these components, and the following discussion presents several exemplary embodiments serving to illustrate different possibilities for implementation. It is understood that many other embodiments are also possible within the spirit and scope of the present invention, as will be obvious to one of ordinary skill. In the various figures, for the sake of clarity of presentation and not limitation of the invention, and wherever possible, similar numbers have been used for labeling components performing corresponding functions in other figures.

Figure 3:
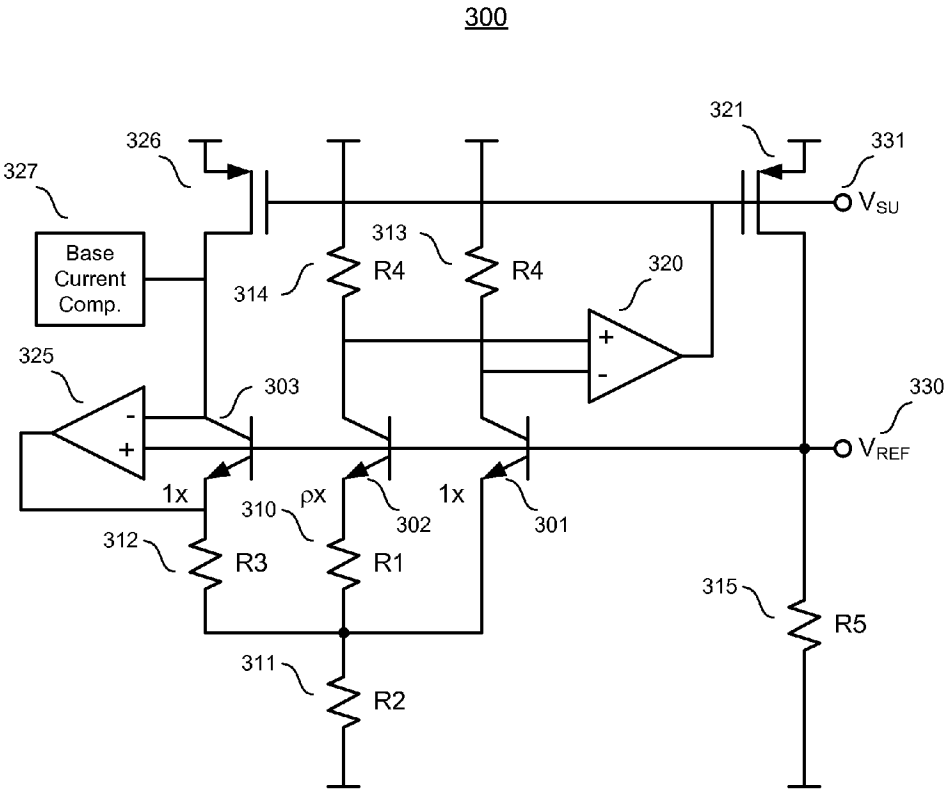
FIG. 3 shows an alternative embodiment of the present invention employing base-current compensation.

FIG. 3 illustrates an embodiment of the present invention demonstrating in more detail one possibility for generating a bias current reference for the collector of BJT 303. Since a constant current is desired to bias the collector of BJT 303, one method of generating that current is to derive it from the output reference voltage, $V_{REF}$ 330. In this embodiment, resistor R5 315 is connected from node $V_{REF}$ 330 to ground and therefore conducts a substantially temperature-independent current equal to $V_{REF}$/R5. That current flows in PMOS device 321 and a current proportional to it is reproduced via PMOS device 326. The current mirror formed by PMOS devices 321 and 326 is operated by amplifier 320 and the system finds an equilibrium bias point when the reference voltage is substantially equal to $V_{G0}$ (when properly trimmed). Operational amplifier 325 serves the function of ensuring that the collector current of BJT 303 tracks the current provided by PMOS device 326, which is largely independent of temperature. Operational amplifier 325 also ensures that the drain voltages of PMOS devices 321 and 326 match each other, thereby eliminating a primary source of systematic offset in the current mirror.

The current flowing in PMOS device 321 also includes the base currents of BJT devices 301-303. The base currents are generally not constant over temperature and—depending on the current gain of BJT devices 301-303—can collectively represent a significant error source if not properly compensated. In the embodiment of FIG. 3, optional base current compensation block 327 diverts a current equal to that contributed by the base currents of the BJT devices 301-303 via the PMOS current mirror so that the collector current of BJT device 303 is nominally independent of the base currents and accuracy of the curvature correction is thereby improved. In other respects, the embodiment of FIG. 3 operates according to the principles outlined in reference to FIG. 2.

Figure 4:
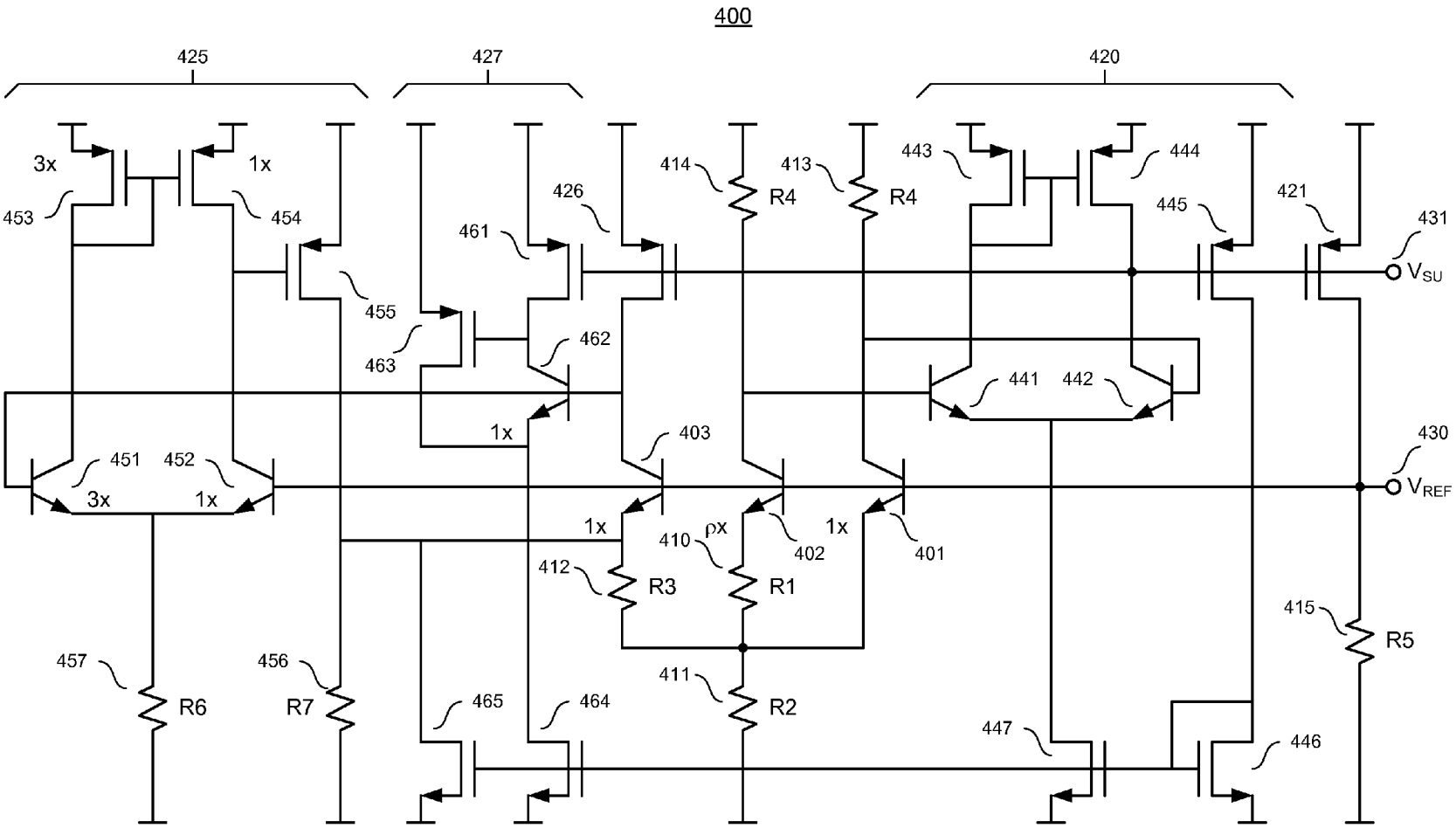
FIG. 4 shows a detailed schematic of an embodiment corresponding to the embodiment of FIG. 3.

FIG. 4 shows an embodiment corresponding to FIG. 3 including transistor-level details for amplifiers 420 and 425 and base current compensation block 427. Amplifier 420 comprises BJT devices 441-442, PMOS devices 443-445 and NMOS devices 446-447. The use of a BJT input stage comprising BJT devices 441-442 has the advantage that any offset voltage due to the input stage will tend to be PTAT. Input offset of amplifier 420 refers to the reference voltage, $V_{REF}$ 430, by the ratio R2/R4. For example, if the supply voltage is on the order of 1.5V, one possible design choice is that R2=R4, in which case the gain from amplifier 420 offset voltage to $V_{REF}$ 430 is approximately one. Thus, a PTAT offset voltage from amplifier 420 will produce an equal PTAT component in $V_{REF}$ 430. Such a component can be easily compensated within the normal trimming process of the bandgap. Input stage base currents drawn by BJT devices 441-442 do not contribute any systematic error to the reference voltage $V_{REF}$ 430, provided that the currents match. Input offset current of amplifier 420 contributes to reference voltage $V_{REF}$ 430 with a transresistance gain of R2.

To reduce systematic offsets, the operational amplifier 420 is self-biased via PMOS 445 and NMOS current mirror devices 446-447. By correctly selecting the NMOS and PMOS device geometries, the systematic offset of operational amplifier 420 can be essentially eliminated. The key to doing so is to make certain that PMOS devices 443-445 have identical gate lengths and current densities. Then, the drain voltages of PMOS devices 443-444 will be substantially equal making the amplifier biasing nominally symmetric. This one purpose of the self-biasing loop comprising devices 445-447.

Operational amplifier 425 comprises BJT devices 451-452, PMOS devices 453-455, NMOS device 465 and resistors 456-457. In amplifier 425, BJT device 451 has three times the emitter area of BJT device 452 and is designed to conduct three times the collector current. Since the base voltages of devices 451-452 are nominally equal to $V_{REF}$ 430, a PTAT current will flow in resistor 457, making both collector currents PTAT. Assuming that the collector current flowing in BJT device 452 matches the collector currents flowing in BJT devices 401-402, the base current drawn by BJT device 451 will equal the sum of the base currents of BJT devices 401-402 and BJT device 452. Note that the base of BJT device 451 attaches to the collector of BJT device 403. Thus, BJT device 451 provides base current compensation for the base current component conducted in PMOS device 426 due to base current conduction by BJT devices 401-402 and 452.

Amplifier 425 is also designed to have minimal systematic offset. This is accomplished by causing PMOS devices 453-455 to be of equal length and to conduct equal current densities so that PMOS devices 453-454 will have equal drain voltages and to have BJT devices 451-452 also conduct equal current densities. The BJT devices 451-452 and PMOS devices 453-454 conduct PTAT currents. PMOS device 455 is made to also conduct a PTAT current by virtue of resistor 456. NMOS device 465 provides a substantially temperature independent current to supply the nominal current flow in BJT device 403 so that PMOS device 455 only conducts the PTAT current component provided by resistor 456. By these methods, systematic offsets in amplifier 425 are substantially eliminated. It is also worth noting that the sensitivity of the system to offset voltage of amplifier 425 is very low since the driving impedance at the base of BJT device 451 is very large. Input offset current of amplifier 425 contributes to reference voltage $V_{REF}$ 430 with a transresistance gain of R2/(gm·R3), where gm is the transconductance of BJT device 403. This transresistance gain is significantly less transresistance gain than for amplifier 420 input offset current.

It remains to compensate for base current draw by BJT device 403, which conducts a substantially temperature independent collector current. That function is provided by the base current compensation circuit 427 which comprises BJT device 462, PMOS devices 461 and 463, and NMOS device 464. Compensation circuit 427 causes BJT device 462 to also conduct a substantially temperature independent collector current as provided by PMOS device 461. PMOS device 463 provides a feedback loop around BJT device 462 to equate the collector current of BJT device 462 and PMOS device 461. NMOS device 464 provides two units of temperature-independent current bias to feed the demand of PMOS devices 461 and 463. Since BJT device 462 conducts a temperature-independent collector current, its base current will approximately compensate the base current contributed by BJT device 403 provided that the two BJT devices have equal current gains and provided that the PMOS current mirror gains from PMOS device 421 to PMOS devices 426 and 461 are unity.

Figure 5:
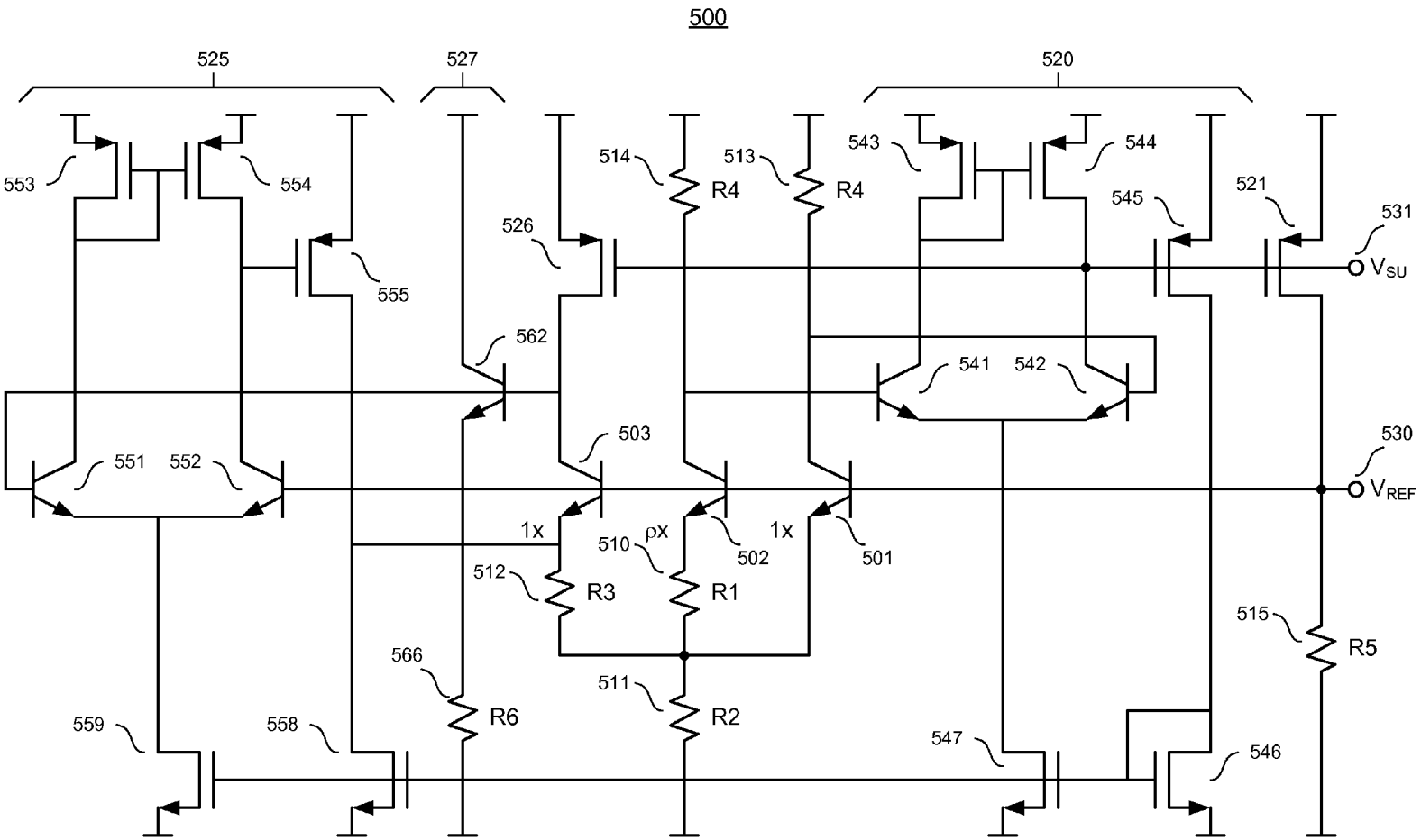
FIG. 5 shows an alternative detailed schematic of an embodiment corresponding to the embodiment of FIG. 3

FIG. 5 illustrates an alternative embodiment of the present invention similar to that of FIG. 4. The embodiment of FIG. 5 differs from that of FIG. 4 in the details of the base-current compensation and the implementation of amplifier 525. In FIG. 5, amplifier 525 is biased with a substantially temperature-independent current flowing in all branches. Thus, the base current flowing in BJT device 551 is related to a substantially temperature-independent collector current and therefore serves to compensate base current conduction from BJT device 503. Compensation of the base current conduction of BJT devices 501-502 (which have PTAT collector currents) is provided by BJT device 562, which is also biased with a PTAT collector current. The PTAT collector current bias of BJT device 562 is provided by virtue of the fact that the base of BJT device 562 is equal to $V_{REF}$ 530 on account of the feedback action of amplifier 525. Thus, attaching a simple resistor 566 between the emitter of BJT device 562 and ground suffices to ensure a PTAT current bias. In other respects, the embodiment of FIG. 5 operates in corresponding fashion to that of FIG. 4.

Figure 6:
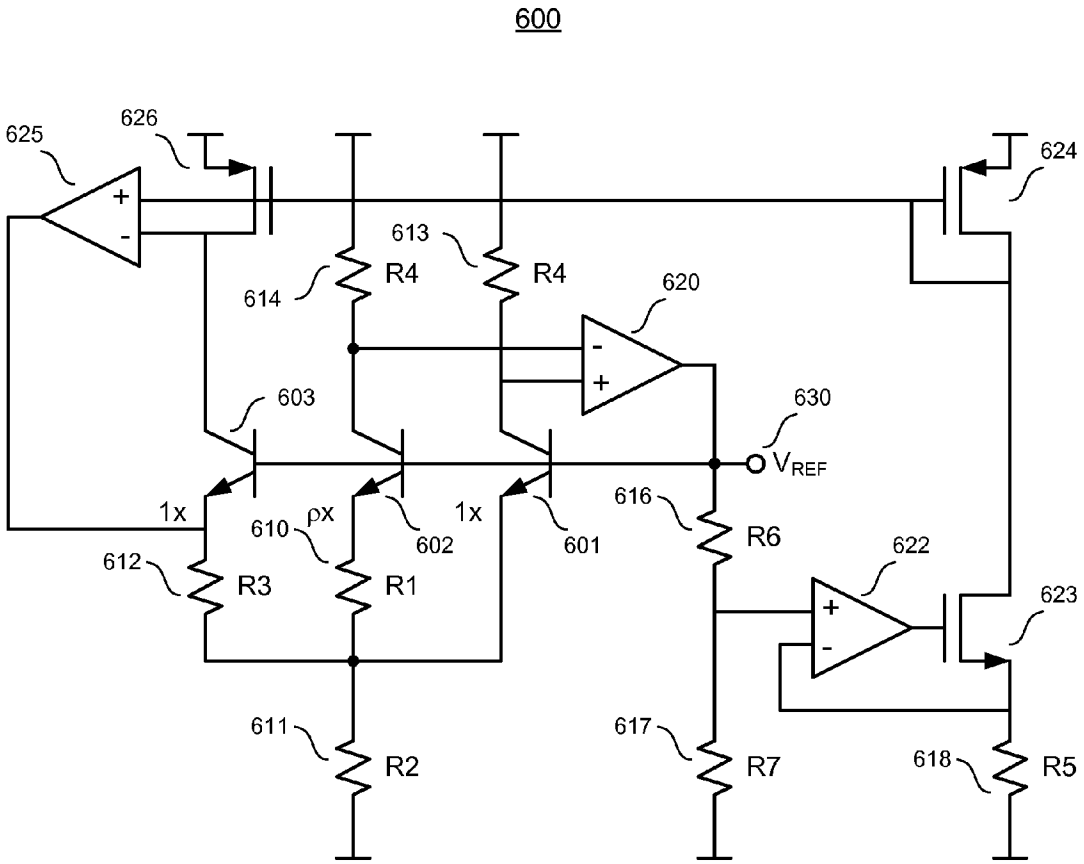
FIG. 6 shows an alternative embodiment of the present invention employing a separate buffer to avoid the use of base-current compensation.

FIG. 6 illustrates an alternative embodiment of the present invention that does not employ base current compensation as in the embodiments of FIGS. 3-5. In this embodiment, the current conducted by PMOS device 624 is provided by a voltage-to-current converter comprising operational amplifier 622, NMOS device 623 and resistors 616-618. The use of a voltage-to-current converter eliminates any dependence of the drain current of PMOS device 624 on the base currents of BJT devices 601-603. Note that PMOS device 624 is now diode-connected, meaning that its gate and drain voltages are equal. In this embodiment, operational amplifier 625 again ensures that the drain voltages of PMOS devices 624 and 626 are substantially equal. As before, the equality of the drain voltages eliminates a primary source of systematic offset in the current mirror formed by PMOS devices 624 and 626. The use of a resistive divider formed by resistors 616-617 is optional but may be useful in some embodiments for managing the supply headroom required by the voltage-to-current converter, as will be evident to one of ordinary skill. In other respects, the embodiment of FIG. 6 operates according to the principles outlined in reference to FIG. 2.

Figure 7:
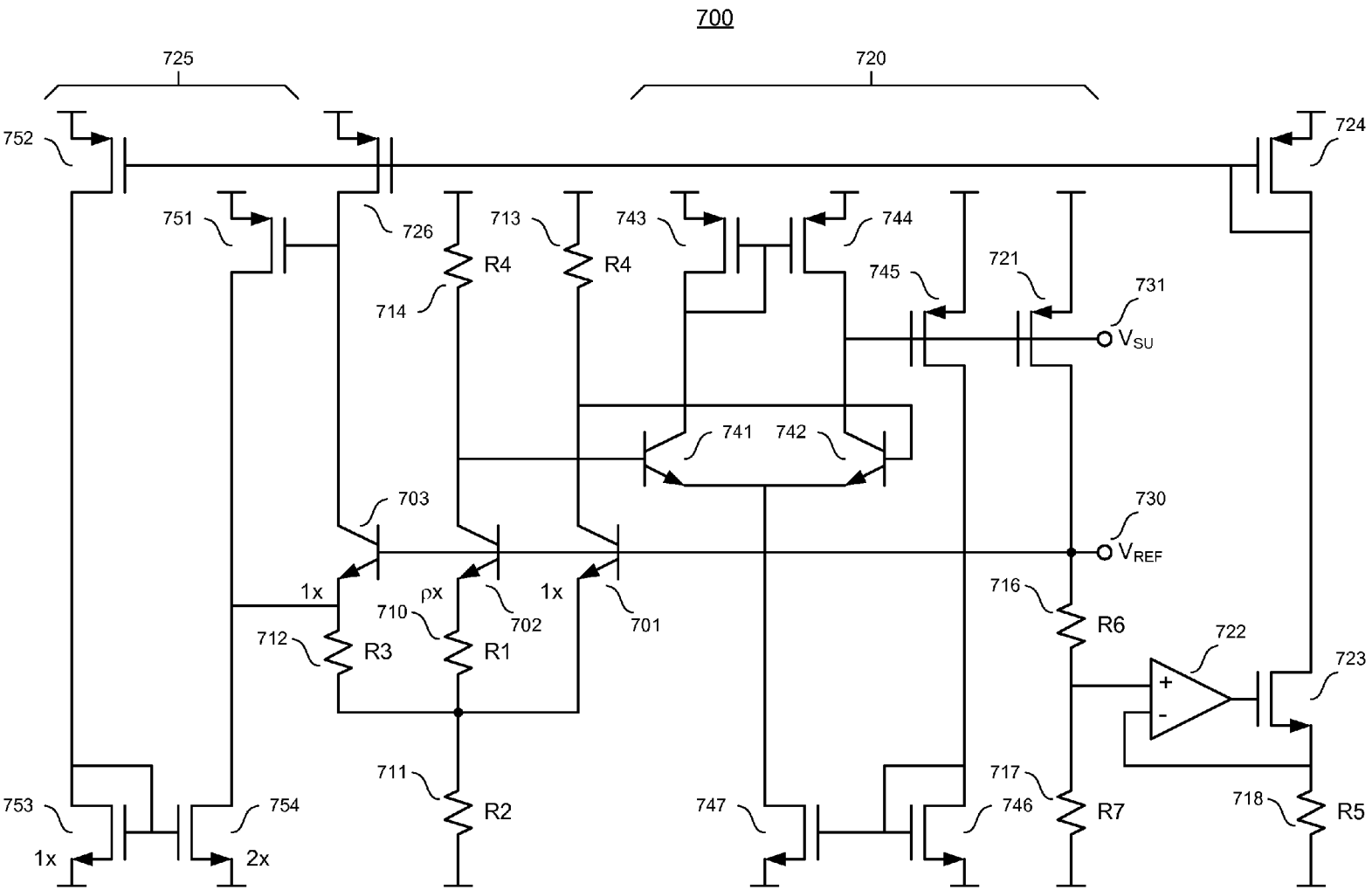
FIG. 7 shows a detailed schematic of an embodiment corresponding to the embodiment of FIG. 6

FIG. 7 illustrates an embodiment of the present invention corresponding to that of FIG. 6 but including additional details of one possible transistor-level implementation. In this implementation, amplifier 720 is implemented much in the same way as in the embodiments of FIG. 4 and FIG. 5. However, amplifier 725 employs a transistor-level implementation different from the embodiments of FIG. 4 and FIG. 5. Amplifier 725 comprises PMOS devices 751-752 and NMOS devices 753-754. The feedback action provided by this amplifier causes the drain voltage of PMOS device 726 to equal that of PMOS device 724. Systematic offsets of amplifier 725 can be reduced by selecting the length and current densities of PMOS devices 751-752 to be equal to those of PMOS devices 724 and 726 and by selecting the lengths and current densities of NMOS devices 753-754 to be equal while the width of NMOS device 754 is twice that of NMOS device 753. In contrast to corresponding amplifier 425 of the embodiment of FIG. 4, there is no input offset current associated with amplifier 725 due to the use of PMOS devices 751-752 for the input stage. Note that the embodiment of FIG. 7 also omits the use of base current compensation since such compensation is not needed in this embodiment.

Figure 8:
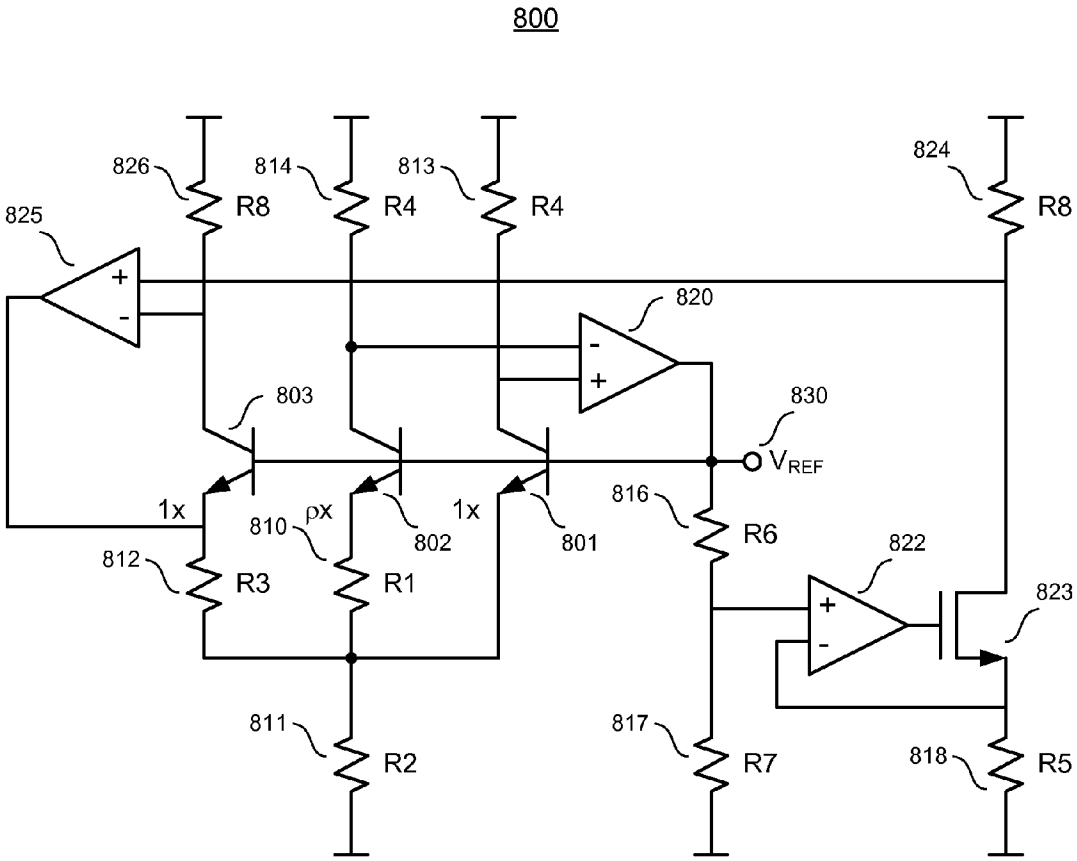
FIG. 8 shows an alternative embodiment of the present invention employing resistive loads to avoid the use of a current mirror.

FIG. 8 illustrates an alternative embodiment of the present invention that further avoids the use of PMOS current mirrors (and their related offsets and noise) in generating the collector reference current for BJT device 803. In this embodiment, resistor 824 receives the current generated by the voltage-to-current converter comprising operational amplifier 822, NMOS device 823 and resistors 816-818. Operational amplifier 825 ensures that the voltage drop across resistors 824 and 826 are equal, which implies that their currents must be proportional to the ratio of their resistor values. If the resistor values are equal (as indicated in the Figure), then the currents flowing in the two resistors will also be equal. Thus, BJT device 803 is made to conduct a collector current proportional to that provided by the voltage-to-current converter, which is largely independent of temperature. In other respects, the embodiment of FIG. 8 operates according to the principles outlined in reference to FIG. 2.

An advantage of the embodiment of FIG. 8 when compared to that of FIG. 6 is that current mirror offset contributions contributed by PMOS devices 624 and 626 are avoided, while operational amplifier offsets are easily managed as the gain from amplifier offset to the reference voltage node, $V_{REF}$ 830, is unity or less. For example, assuming that the voltage drop across resistors 811, 813-814, 817-818, 824 and 826 are on the order of 0.5V (easily achievable for supply voltages of 1.5V or greater), the gain for voltage offset of amplifier 820 is approximately unity; the gain for voltage offset of amplifiers 822 and 825 are each approximately 1/10. (In this exemplary calculation, it is assumed that the thermal voltage is about 25 mV and that m=3.) Thus, the offset voltages of amplifiers 822 and 825 are relatively unimportant. The offset voltage of amplifier 820 is most critical and should be held to 1 mV or less for 0.1% accuracy. But, this offset can be made largely PTAT by employing a BJT input stage in amplifier 820, as has been described in reference to prior figures. Any PTAT offset contributed to the output can be incorporated into the trimming of the bandgap reference so that no net error in the output voltage is incurred.

Figure 9:
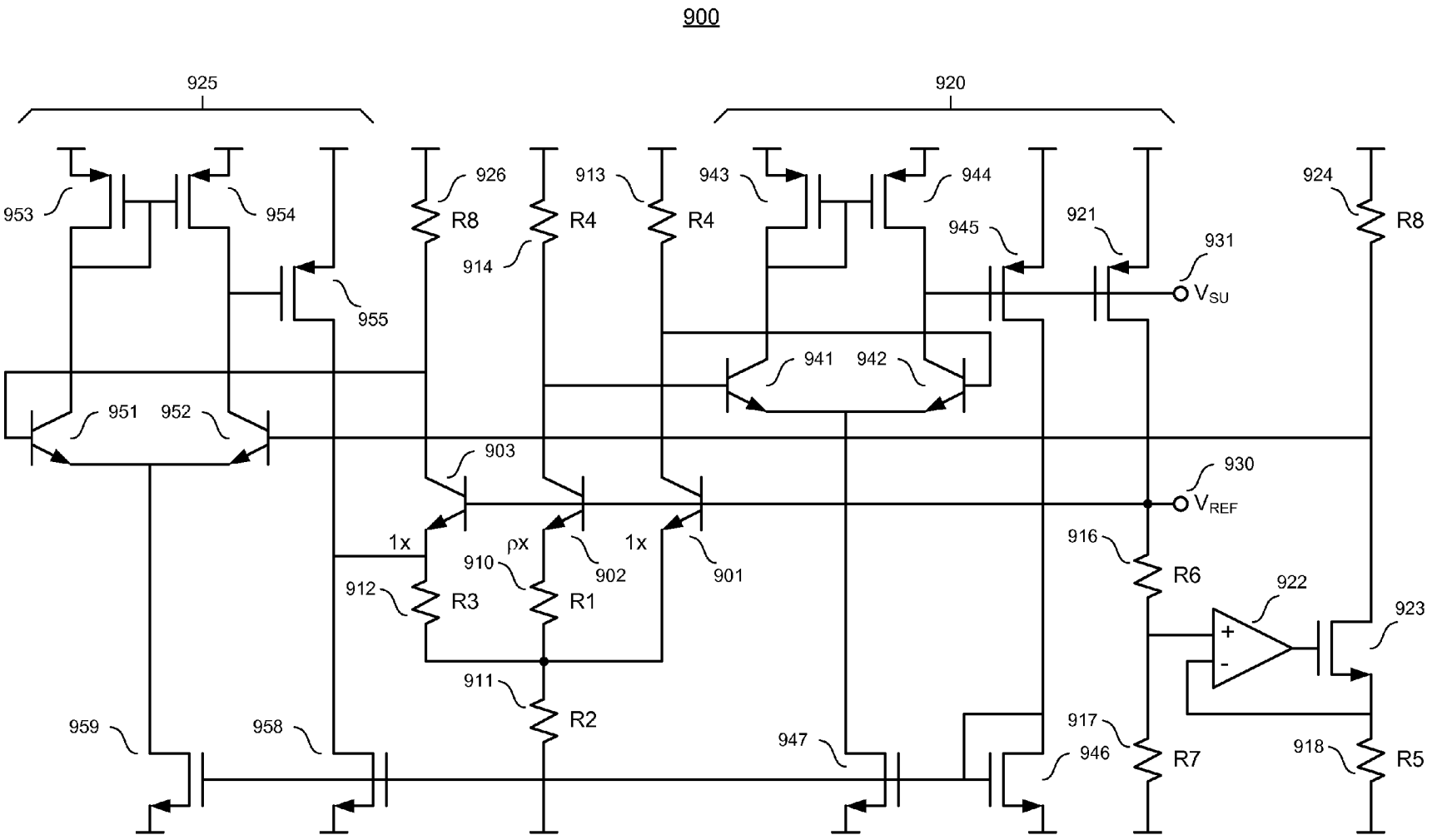
FIG. 9 shows a detailed schematic of an embodiment corresponding to the embodiment of FIG. 8.

FIG. 9 illustrates another embodiment of the present invention corresponding to that of FIG. 8 with additional transistor-level details. In particular, details of a possible transistor-level implementation of amplifier 925 are provided. This amplifier employs a topology similar to that of amplifier 920 and comprises BJT devices 951-952, PMOS devices 953-955 and NMOS devices 958-959. All branches are biased to conduct substantially temperature-independent currents and the systematic offset of the amplifier may be minimized by making the PMOS devices 953-955 to have equal lengths and equal drain current densities and by further making the BJT device 951-952 have equal collector current densities. Note that the use of a BJT input stage in amplifier 925 has the added benefit that input voltage offset of the amplifier will be substantially PTAT and any error in $V_{REF}$ 930 resulting from that offset can be absorbed into the general bandgap trimming scheme.

Figure 10:
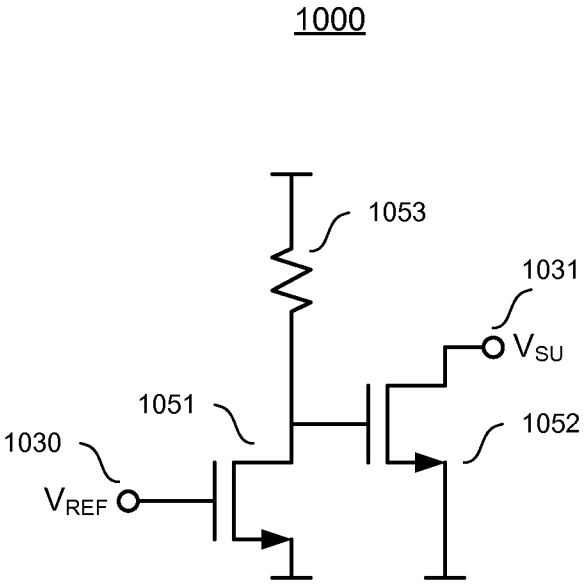
FIG. 10 shows a schematic of a start-up circuit compatible for use with the present invention.

Since the embodiments of FIGS. 2-9 are self-biased systems, there will generally be a need for start-up circuitry to be added to ensure steady-state operation at the desired equilibrium point, as is the case in most bandgap references. As the design and use of start-up circuits will be familiar to one of ordinary skill, detailed attention is not given to teaching them here. However, for the sake of clarity and completeness, an exemplary start-up circuit that can be employed by the foregoing embodiments is shown for reference in FIG. 10. In this start-up circuit, NMOS device 1051 monitors the reference voltage, $V_{REF}$ 1030. If the circuit has not started, then the voltage of $V_{REF}$ 1030 will be low, causing NMOS device 1051 to be off. In that situation, resistor 1053 will pull up the gate of NMOS device 1052 causing the drain of NMOS 1052 to conduct and pull down node $V_{SU}$ 1031. Node VSU 1031 has been identified with corresponding numbers in FIGS. 3-5, 7 and 9 and is a control point dictating current flow throughout the bandgap. By pulling it down, the circuitry will begin to start-up and conduct current, thereby raising the voltage $V_{REF}$ 1030. Once $V_{REF}$ 1030 reaches a sufficient voltage, NMOS device 1051 will conduct and pull down the gate of NMOS device 1052 via resistor 1053. In normal operation, when $V_{REF}$ 1030 is substantially equal to the bandgap voltage, NMOS device 1051 should be sufficiently strong to completely shut off NMOS device 1052 so that the start-up circuit does not draw any further current from node $V_{SU}$ 1031.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A curvature-corrected bandgap reference, comprising:

a Brokaw bandgap circuit; the Brokaw bandgap circuit including an output node providing a reference voltage;

the Brokaw bandgap circuit further comprising a first BJT device including a first base terminal coupled to the output node and a first emitter terminal, wherein the first BJT device operates at a first current density that is substantially proportional to absolute temperature;

a second BJT device including a second base terminal coupled to the output node and a second emitter terminal, wherein the second BJT device operates at a second current density that is substantially independent of temperature;

a correction voltage proportional to a voltage difference of the first and second emitter terminals, wherein the correction voltage substantially cancels a curvature of the reference voltage; and a first circuit operable to force the second current density to be substantially proportional to the reference voltage; wherein the Brokaw bandgap circuit further comprises a third BJT device operating at a third current density that is substantially proportional to absolute temperature, the third current density being less than the first current density by a fixed ratio; wherein the first circuit further includes a resistor coupled to the reference voltage; a current mirror coupled to the resistor and to a collector of the second BJT device; and a base current compensation block coupled to the collector of the second BJT device which diverts a current nominally equal to that contributed by base currents of the first second and third BJT devices such that the second current density is nominally independent of the base currents of the first, second and third BJT devices, wherein accuracy of curvature correction is thereby improved.

2. The curvature-corrected bandgap reference of claim 1, further comprising:

a resistor coupled between the first and second emitter terminals, wherein the resistor conducts a current proportional to a difference between the first and second emitter terminals.

3. The curvature-corrected bandgap reference of claim 1, wherein:

the first current density is substantially equal to the second current density at a reference temperature.

4. The curvature-corrected bandgap reference of claim 1, further comprising:

a start-up circuit coupled to the output node for ensuring steady-state operation of the Brokaw bandgap circuit at a desired equilibrium point.

5. A curvature-corrected bandgap reference, comprising:

a first BJT device operating at a first current density that is substantially proportional to absolute temperature, the first BJT device having a first base-emitter voltage and a first base terminal;

a second BJT device operating at a second current density that is substantially proportional to absolute temperature, the second current density being less than the first current density, the second BJT device having a second base-emitter voltage and a second base terminal;

a third BJT device operating at a third current density that is substantially independent of temperature, the third BJT device having a third base-emitter voltage and a third base terminal; wherein the first, second and third base terminals operate at a reference voltage, wherein the reference voltage comprises a linear combination of the first, second and third base-emitter voltages and is thereby made substantially independent of temperature and curvature-corrected; wherein the linear combination is provided by summing the first base-emitter voltage, a proportional to absolute temperature (PTAT) voltage proportional to a difference between the first and second base-emitter voltages, and a curvature-correction voltage proportional to a difference between the first and third base-emitter voltages.

6. The curvature-corrected bandgap reference of claim 5 further comprising:

a first circuit that monitors the first and second current densities and adjusts the reference voltage to maintain a fixed ratio between them.

7. The curvature-corrected bandgap reference of claim 6 wherein:

the first circuit monitors collector currents of the first and second BJT devices.

8. The curvature-corrected bandgap reference of claim 7, further comprising:

a second circuit that monitors the third current density and maintains it to be substantially proportional to a reference voltage.

9. The curvature-corrected bandgap reference of claim 8, wherein:

the second circuit monitors a collector current of the third BJT device.

10. The curvature-corrected bandgap reference of claim 9, wherein:

the second circuit further includes a resistor coupled to the reference voltage; a current mirror coupled to the resistor and to a collector of the third BJT device; and a base current compensation block coupled to the collector of the third BJT device which diverts a current nominally equal to that contributed by base currents of the first second and third BJT devices; such that the third current density is nominally independent of the base currents of the first, second and third BJT devices, wherein accuracy of curvature correction is thereby improved.

11. The curvature-corrected bandgap reference of claim 9, wherein:

the second circuit further includes a voltage-to-current converter coupled to the reference voltage and a current mirror coupled to the voltage to current converter and to a collector of the third BJT device; wherein any dependence of the drain current of any element of the current mirror on base currents of first, second and third BJT devices is eliminated.

12. The curvature-corrected bandgap reference of claim 9, wherein:

the second circuit further includes first and second resistors, a voltage-to-current converter coupled to the reference voltage and to one of the first and second resistors and other of the first and second resistors coupled to an operational amplifier and a collector of the third BJT, wherein the operational amplifier ensures that voltage drops across the first and second resistors are equal by adjusting the second current density.

13. The curvature-corrected bandgap reference of claim 9, further including:

a start-up circuit coupled to the output node for ensuring steady-state operation of the Brokaw bandgap circuit at a desired equilibrium point.

14. A curvature-corrected bandgap reference, comprising:

a Brokaw bandgap circuit; the Brokaw bandgap circuit including an output node providing a reference voltage;

the Brokaw bandgap circuit further comprising a first BJT device including a first base terminal coupled to the output node and a first emitter terminal, wherein the first BJT device operates at a first current density that is substantially proportional to absolute temperature;

a second BJT device including a second base terminal coupled to the output node and a second emitter terminal, wherein the second BJT device operates at a second current density that is substantially independent of temperature;

a correction voltage proportional to a voltage difference of the first and second emitter terminals, wherein the correction voltage substantially cancels a curvature of the reference voltage; and a first circuit operable to force the second current density to be substantially proportional to the reference voltage; wherein the Brokaw bandgap circuit further comprises a third BJT device operating at a third current density that is substantially proportional to absolute temperature, the third current density being less than the first current density by a fixed ratio; wherein the first circuit further includes a voltage-to-current converter coupled to the reference voltage and a current mirror coupled to the voltage to current converter and to a collector of the second BJT device; wherein any dependence of a current drain of any element of the current mirror on base currents of first, second and third BJT devices is eliminated.

15. A curvature-corrected bandgap reference, comprising:

a Brokaw bandgap circuit; the Brokaw bandgap circuit including an output node providing a reference voltage;

the Brokaw bandgap circuit further comprising a first BJT device including a first base terminal coupled to the output node and a first emitter terminal, wherein the first BJT device operates at a first current density that is substantially proportional to absolute temperature;

a second BJT device including a second base terminal coupled to the output node and a second emitter terminal, wherein the second BJT device operates at a second current density that is substantially independent of temperature;

a correction voltage proportional to a voltage difference of the first and second emitter terminals, wherein the correction voltage substantially cancels a curvature of the reference voltage; and a first circuit operable to force the second current density to be substantially proportional to the reference voltage; wherein the Brokaw bandgap circuit further comprises a third BJT device operating at a third current density that is substantially proportional to absolute temperature, the third current density being less than the first current density by a fixed ratio; wherein the first circuit further includes first and second resistors, a voltage-to-current converter coupled to the reference voltage and to one of the first and second resistors and other of the first and second resistors coupled to an operational amplifier and a collector of the second BJT, wherein the operational amplifier ensures that voltage drops across the first and second resistors are equal by adjusting the second current density.

* * * * *